US005829294A

United States Patent [19]

Bradbury et al.

[11] Patent Number: 5,829,294

[45] **Date of Patent: *Nov. 3, 1998**

[54] SPLIT-LEVEL ROLL FORMER

[75] Inventors: Philip E. Bradbury, McPherson; Karl E. Voth, Hesston, both of Kans.

[73] Assignee: The Bradbury Company, Inc., Moundridge, Kans.

[ * ] Notice: Under U.S.C. 154(b), the term of this patent shall be extended for 200 days.

[21] Appl. No.: 786,741

[22] Filed: Jan. 27, 1997

Related U.S. Application Data

[63] Continuation of Ser. No. 323,273, Oct. 14, 1994, abandoned.

[51] Int. Cl.[6] ..... B21D 5/08

[52] U.S. Cl. ..... 72/176; 72/181; 72/226; 72/237; 72/239; 72/247; 74/571 M; 74/397

[58] Field of Search ..... 72/176, 181, 226, 72/239, 247, 237, 248, 232; 74/571 M, 571 L, 397

[56] References Cited

U.S. PATENT DOCUMENTS

| | | | |
|---|---|---|---|
| 1,125,984 | 1/1915 | Dumas . | |
| 1,669,411 | 5/1928 | Clark . | |
| 2,102,355 | 12/1937 | Cummins | 80/54 |
| 2,195,398 | 4/1940 | Duda | 64/30 |
| 2,561,634 | 7/1951 | Picton | 153/54 |
| 2,601,794 | 7/1952 | Wood . | |
| 2,664,019 | 12/1953 | Henderson | 80/35 |
| 2,774,263 | 12/1956 | Leufven . | |
| 3,345,849 | 10/1967 | Lowy | 72/249 |
| 3,348,403 | 10/1967 | Bartley . | |
| 3,452,568 | 7/1969 | Vihl | 72/137 |
| 3,823,592 | 7/1974 | Colbath | 72/181 |
| 4,033,165 | 7/1977 | Arimura et al. | 72/205 |
| 4,237,714 | 12/1980 | Polukhin et al. | 72/242 |
| 4,368,633 | 1/1983 | Nogota | 72/239 |
| 4,724,695 | 2/1988 | Stoehr | 72/181 |
| 4,787,232 | 11/1988 | Hayes | 72/176 |
| 4,969,347 | 11/1990 | Matsuo et al. | 72/247 |
| 4,974,435 | 12/1990 | Vandenbroucke | 72/176 |
| 5,158,002 | 10/1992 | Matsunaga et al. | 73/479 |
| 5,163,311 | 11/1992 | McClain et al. | 72/181 |

FOREIGN PATENT DOCUMENTS

| | | |
|---|---|---|
| 1 777 039 | 10/1971 | Germany . |
| 42-4763 | 2/1967 | Japan . |

OTHER PUBLICATIONS

"Split Level Roll Former Speeds Changeover," reprinted from *Modern Metals* Feb. 1996.

"Metsec's New Rollforming Line Answers the Call," reprinted from *Sheet Metal Industries*, Nov. 1995.

"New Bradbury System Helps Cut Rollforming Set–Up Time," reprinted from *Metal Construction News*, May 1995.

"System Prevents The Problem Of Camber In Purlin Manufacturing," reprinted from *Metal Construction News*, Apr. 1996.

(List continued on next page.)

*Primary Examiner*—Daniel C. Crane

*Attorney, Agent, or Firm*—Marshall, O'Toole, Gerstein, Murray & Borun

[57] ABSTRACT

A roll former line for forming different shapes including a first roll stand attached to a bed which provides vertical adjustable movement. The roll stand includes three spindles in vertical alignment with each other, the forming rolls on the top and bottom spindles working against opposite sides of the middle forming roll, so as to provide reverse shapes between the top and middle forming roll and the middle and bottom forming roll. Linear actuators are connected to the bed of the first roll stand for moving the first roll stand vertically on the bed. Opposite the first roll stand on the line is a second roll stand attached to a second bed including two spindles in vertical alignment and corresponding forming rolls thereon. The first roll stand can be raised or lowered by the linear actuators so as to use reverse forming rolls on the first roll stand in conjunction with the forming rolls on the second roll stand to form a reverse shape on one edge of the sheet being formed.

16 Claims, 4 Drawing Sheets

OTHER PUBLICATIONS

Supplemental Declaration of H. David Bradbury.
Documents numbered 000300–000474.
Documents numbered 000500–000526.
Document numbered 000530.
Documents numbered 000550–000564.
Documents numbered 000600–000634.
Documents numbered 000650–000665.
Documents numbered 000700–000716.
Documents numbered 000750–000759.
Documents numbered 000800–000828.
Documents numbered 000850–000855.
Documents numbered 000900–000910.
Documents numbered 000920–000924 (documents generated from data currently stored in Bradbury's SYMIX system; work order 26643 is for warranty for purlin line).
Drawing sheets numbered 000001–000029 relating to MBCI roll former.
Computer printouts numbered 000100–000186 relating to construction and assembly of MBCI roll former.
Documents numbered 000200–000252 relating to problems encountered with MBCI roll former (there are no documents enclosed for numbers 000220–000223).
Bradbury Split Level Rollformer Development Time–Line (4 pages).
Split–Level Roll Former Drawing dated Feb. 22, 1992.
Bradbury Sale Summary re MBCI and P.O. #7120–M.
Bradbury Invoice No. 19689.
Bradbury Invoice No. 20023.
Bradbury Invoice No. 21132.
Dec. 9, 1994 document signed by David Bradbury of Bradbury Company, Inc. and A. R. Ginn of MBCI.
Bradbury Sale Summary re METSEC and P.O. #MS84495.
Bradbury Invoice No. 5–21947.
Bradbury Invoice No. 21948.

SPLIT-LEVEL ROLL FORMER

This application is a continuation of U.S. Ser. No. 08/323,273 filed Oct. 14, 1994 now abandoned.

BACKGROUND OF THE INVENTION

This invention relates to roll forming and more specifically to the rapid change of tooling on roll forming lines to form a different shape of purlin as well as other shapes or vary the dimensions of the shape being formed. In a large roll forming line when it is desired to change the shape of the element being formed, it requires the removal of the existing roll stands and forming rolls and the substitution of other stands and rolls to form the new shape and the alignment of the stands and rolls. In large roll formers, forming for example purlins, it can take up to eight hours to convert the tooling which forms a C-purlin to one that forms a "Z" purlin or vice versa.

One principal method in the industry currently used to perform this change is to provide a complete double set of tooling for the two different shapes, both of which are positioned on a single bed which can quickly move either set into position. The set not in use is positioned laterally on the line and can be moved into place by shifting the bed along lineal bearings into place. Such a method is much quicker than building up separate tool stands and forming rolls individually for the new shape. This last-mentioned concept of a complete double set of tooling has its obvious cost and space disadvantages from that of a single set of tooling which may provide alternate shapes.

Various designs to facilitate a rapid change of tooling in the roll forming industry have been previously designed, as for example, U.S. Pat. No. 4,974,435 which utilizes rotating turret-type tool changers mounted on the separate tool stands.

Another similar turret-like changing process is taught in U.S. Pat. No. 4,724,695 wherein the pairs of roll stands which act on opposite edges of the sheet are rotated about a vertical axis; thus reversing the edge shapes from one side to the other. The concept of varying the width of the web or height of the flange on a purlin by laterally shifting the tooling on its bed is well known in the art, as exemplified in U.S. Pat. No. 5,163,311.

In U.S. Pat. No. 4,787,232, the concept is taught of reversing the forming rolls on a stand from top to bottom by mounting them on a rotatable plate somewhat similar to the turret design previously mentioned.

SUMMARY OF THE INVENTION

The present invention provides an improved method and machine for roll forming alternate purlin shapes with a minimum tool change time between shape changes. The machine comprises adjacent pairs of roll stands with one stand including three spindles and corresponding forming rollers while the opposite stand includes two spindles and supporting forming rolls. The three-spindle stand has vertical adjustment means so that alternate tooling between the first and second spindle or the second and third spindle can be used in conjunction with tooling on the two-spindle roll stand. The machine further includes a split level bed whereby the two spindle roll stand is supported on a horizontal rail for horizontally adjusting the position of the roll stand to vary the web width of the section being formed. The bed of the machine has a second level portion which supports the three-roll stand on an adjustable height base which can be shifted vertically so as to alternately use the forming rolls on the three-spindle stand so as to provide either a Z-purlin or a C-purlin. On the two-spindle stand, at least one of the forming rolls is adjustable in a vertical plane to handle various thicknesses of material. On the three-spindle stand the top and bottom spindles are also adjustable on a vertical plane to a gap adjustment between the forming rolls when different gauge material is utilized.

When it is desired to alter the shape of a purlin being formed, such as increasing the width of the web, the roll stands are shifted laterally on the bed of the roll former on lineal bearings by screw-type linear actuators or hydraulic actuators. All of the roll stands on each side of the machine will move together as a single unit since they are all mounted on a longitudinal base plate.

DESCRIPTION OF THE PREFERRED EMBODIMENT

Figure 1:
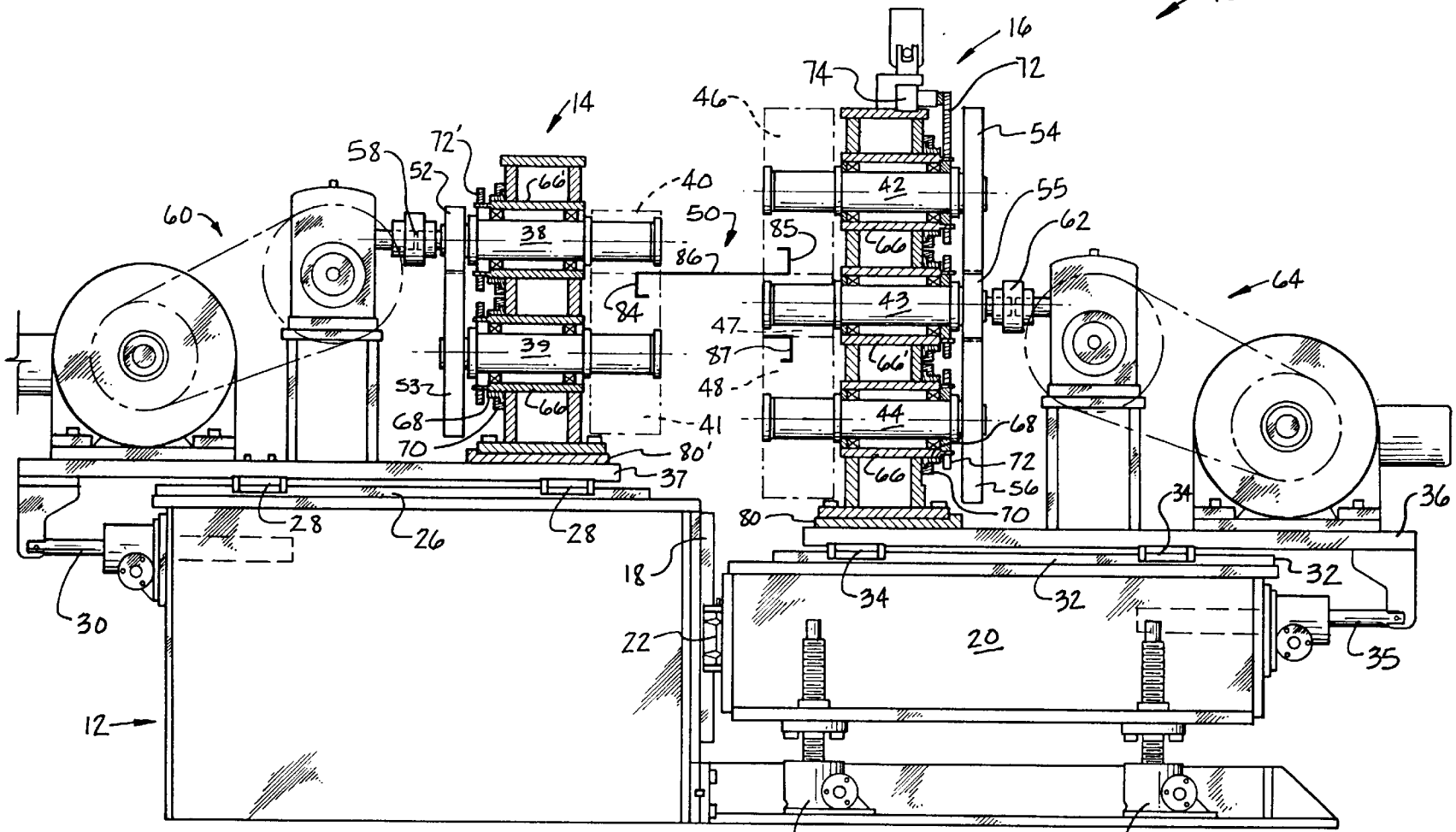
FIG. 1 is an end view of a roll former illustrating one one pair of roll stands of the present invention with the stands shown partially in section.

The machine of the present invention is generally described by reference numeral 10 as a roll former or roll former line which includes a series of stations or pairs of roll stands 14 and 16, as illustrated in FIG. 1. The number of progressive stations in the overall roll former 10 will vary depending upon the particular profile of the shape being formed. The shape being formed in FIG. 1 is a Z-purlin 50 having a web 86 and identical flanges 84 and 85. FIG. 3 is merely an illustrated example of a seventeen station roll former line 10 and FIG. 2 is a group 82' of two spindle roll stand stations.

The roll former 10 of the present invention has particular utility in the forming of Z-purlins or C-purlins. While the overall roll former 10 will include multiple progressive stations of pairs of roll stands, FIG. 1 illustrates in detail only a single pair of opposing roll stands positioned to form a Z-purlin 50, as symbolically shown.

Roll former 10 comprises a longitudinally extending bed 12 which supports pairs of two-spindle roll stands 14 on the left side as seen in FIG. 1 and three-spindle stands 16 located on the right side of the machine. The roll former 10 is a split-level design wherein the two-spindle roll stands 14 are located on the left side of stationary bed 12 while the three-spindle roll stands 16 are positioned on a lower level on a movable base 20 which adjusts vertically along linear bearing post 18 through the coordinated action of linear screw actuators 24. The vertical up-and-down movement of base 20 is guided by journal slide 22 on bearing 18 and the actuators 24 which are anchored to bed 12. The series of roll stands 16 making up the progressive stations, as seen in FIG. 3, are all mounted on a common longitudinal base plate 80 which in turn is connected to individual roll stand bases 36 which carry journal slides 34 as seen in FIGS. 1 and 3. Linear bearings 32 mounted on base 20 provide lateral horizontal movement of all of the roll stands 16 in the various three groups 81, 82 and 83, as seen in FIG. 3. This sliding movement is provided by linear actuators 35.

Figure 2:
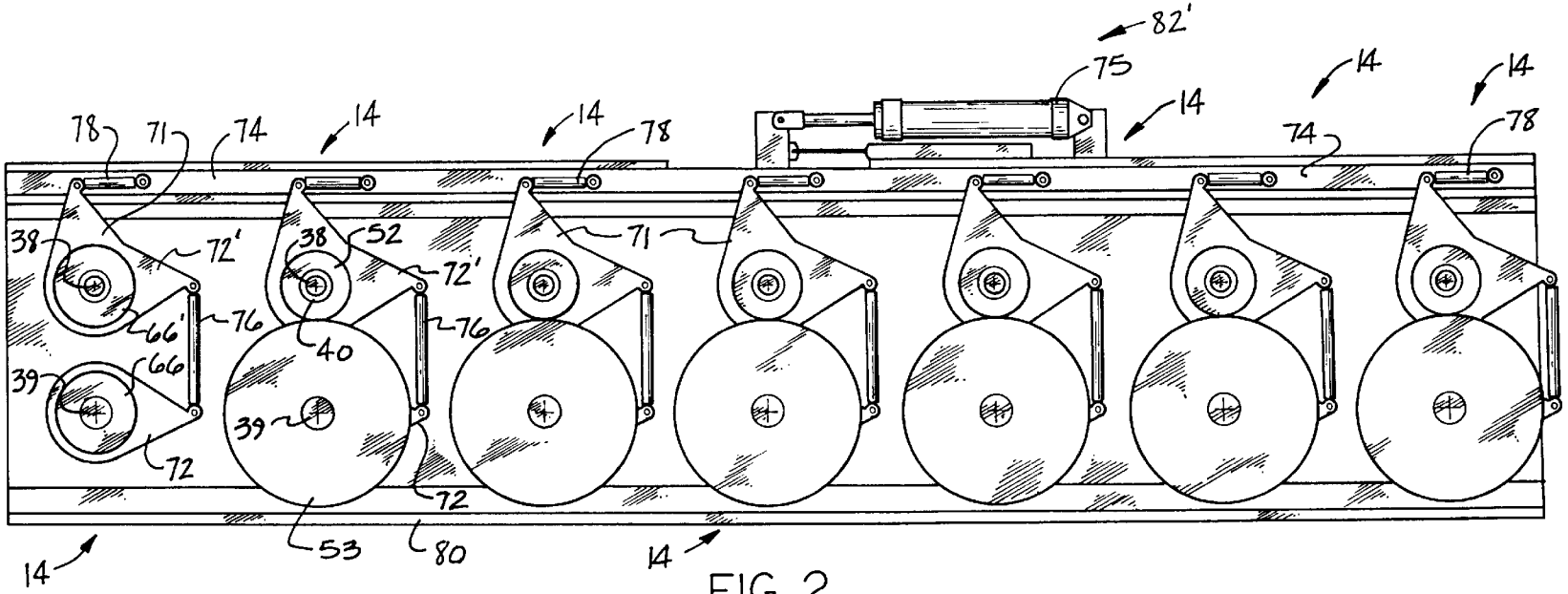
FIG. 2 is a side elevational view of a section from a roll former line illustrating the two spindle roll stands embodying part of the present invention.
Figure 3:
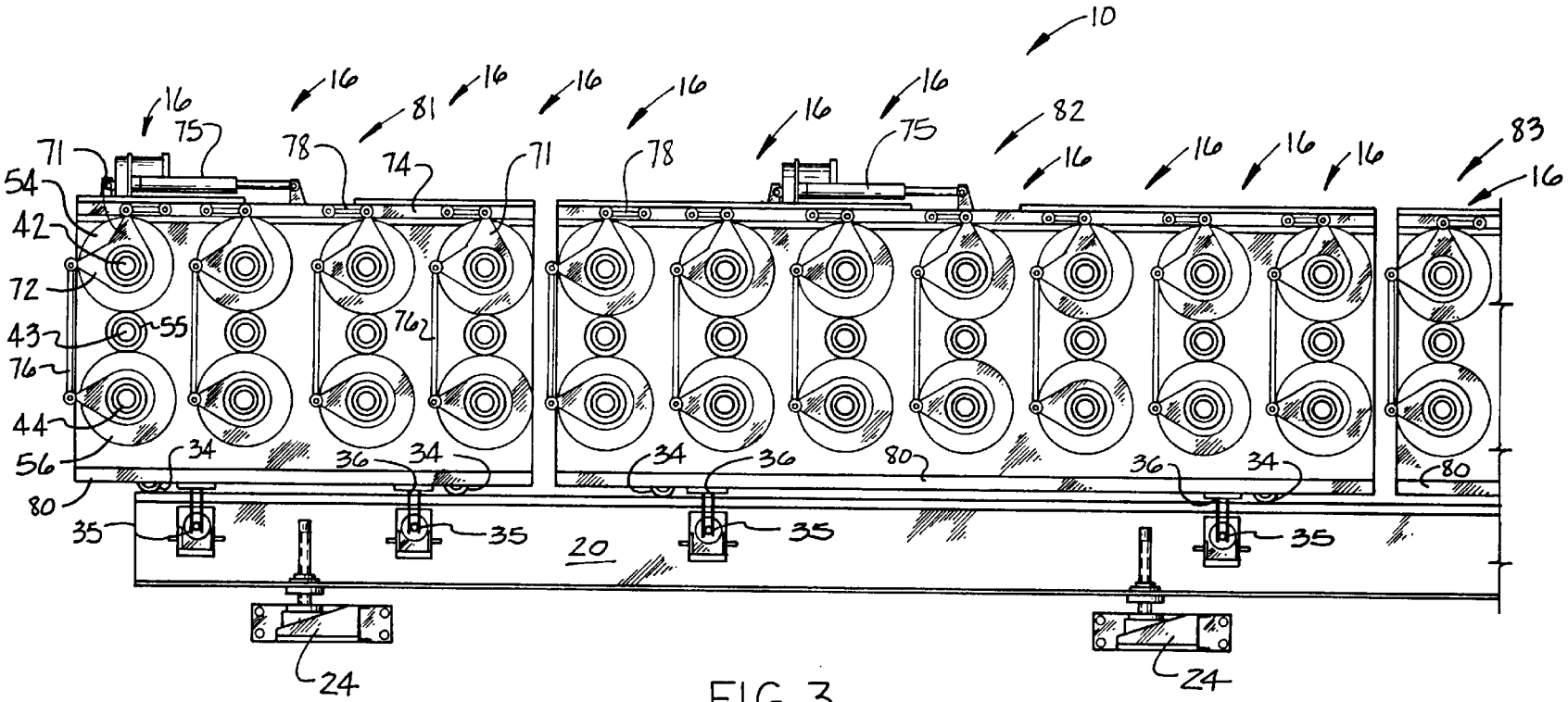
FIG. 3 is a side elevational view of the three-spindle roll stands of the present invention.

The series of two-spindle roll stands 14 make up the group 82', as shown in FIG. 2, and are all mounted on a common longitudinal base plate 80', as shown in FIG. 1. Base plate 80' attaches to individual roll stand bases 37 which in turn carry journal slides 28 which slide laterally along at least two linear bearings 26. While FIG. 1 illustrates linear bearings for movement of both groups of roll stands 14 and 16, only a single group of roll stands and bearings is necessary to vary the width of the purlin web being formed. Either linear bearing 32 or 26 could be eliminated while retaining the same adjustable width function.

On roll stand 14 are a pair of rotatably-journaled spindles 38 and 39 which in turn carry forming rollers 40 and 41, symbolically shown in FIG. 1, forming a downwardly bent purlin flange and lip 84.

Rotatably-journaled to roll stand 16 are three spindles 42, 43 and 44, each respectively carrying forming rolls 46, 47 and 48 symbolically shown. Upper forming roll 46 acts on the top side of center forming roll 47 while identical bottom forming roll 48 acts on the bottom surface of center forming roll 47. Roll stand 16, in its FIG. 1 position, will form a Z-purlin 50, as symbolically illustrated. Forming rolls 46 and 47 will form an upwardly bent flange and lip 85. if it is desired to change the purlin shape from a Z-shape to a C-shape, the groups 81, 82, and 83 of roll stands 16 are elevated until forming rolls 47 and 48 are vertically aligned with the plane of the web 86 of the purlin being formed. The flange now formed on the right end of the purlin will be down-turned, as symbolically illustrated at 87, since the forming rolls 47 and 48 have basically reversed the forming shape to now form a C-purlin.

Both spindles 38 and 39 in the two-spindle roll stand 14 are powered by gear box drive and motor 60 through a drive shaft and coupling 58 directly to spindle 38. The elements in the power train are well known in the prior art and not shown or described in detail. Pinion gear 52 on spindle 38 in turn drives pinion gear 53 attached to spindle 39.

Spindles 42, 43 and 44 in roll stand 16 are likewise driven in a similar manner from gear box drive and motor 64 whose output shaft drives coupling 62 connecting to spindle 43. Also carried on spindle 43 is a pinion gear 55 which in turn drives larger pinion gears 54 and 56 which in turn drive spindles 42 and 44 in the opposite direction of rotation. The gear teeth between the meshing gears just described, have sufficient depth and tolerance fit A (FIG. 4) to accommodate the vertical fine adjustment between the spindles not to disengage or bind. Typically the range of gauges of sheet stock being utilized would vary between gauge 16 and gauge 10 which is approximately a range of .075 inches.

Figure 4:
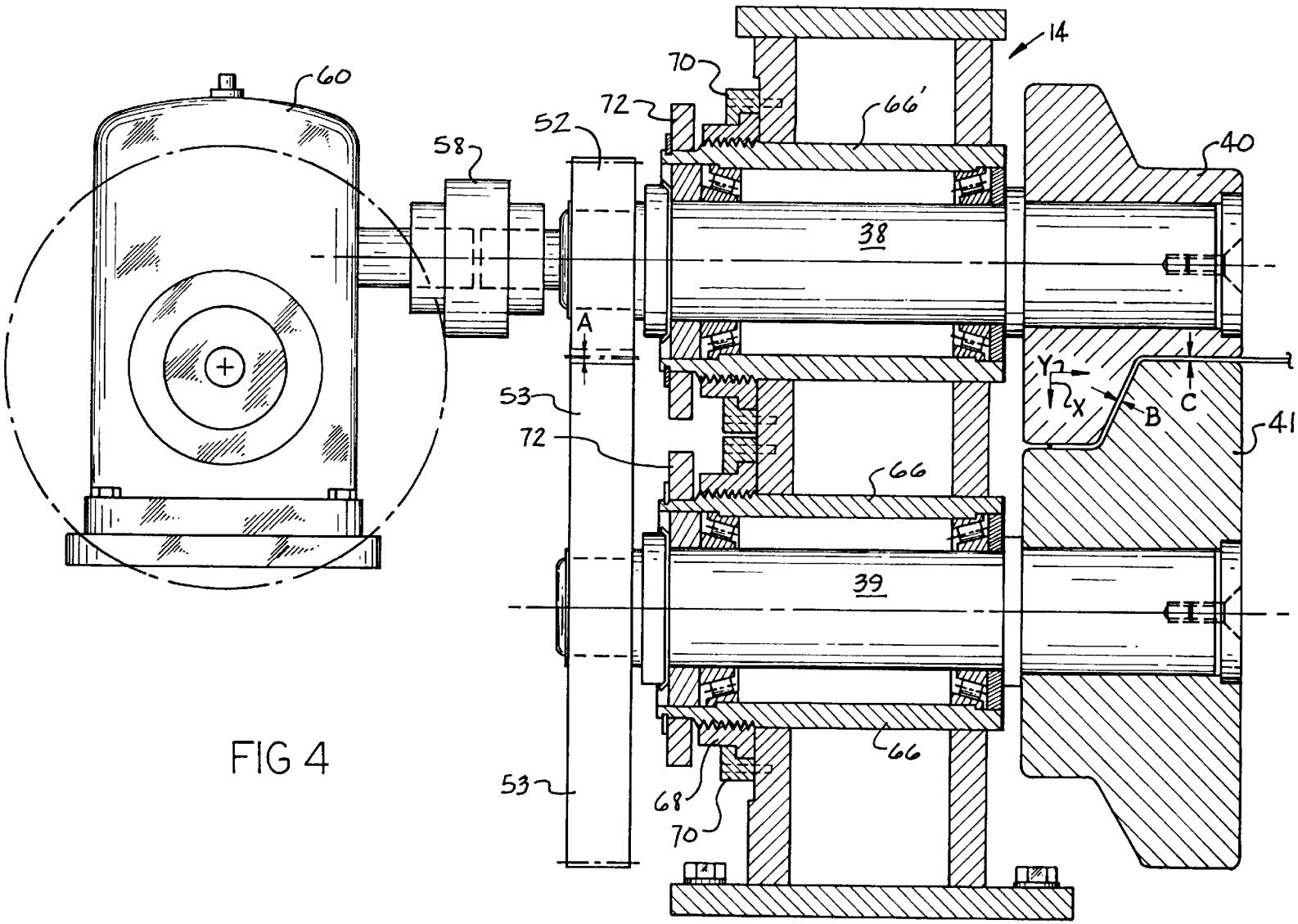
FIG. 4 is a partial sectional view of a roll stand to an enlarged scale illustrating the two-axis adjustment of the forming rolls.

The gap adjustment between forming rollers is illustrated in FIG. 4 on a two-spindle roll stand 14. When the gauge of metal being formed changes on a roll forming stand, the forming rolls 40 and 41 must adjust their position relative to each other along both the Y axis (horizontal) and X axis (vertical), as illustrated in FIG. 4. When moving the forming rollers 40 and 41 closer together or further apart, it is necessary that they be moved relative to each along both the X and Y axis, so that the gaps C and B between the rollers will stay the same. In other words, when rolling a thinner gauge material, forming roll 41 must be moved upwardly, closer to forming roll 40 and also to the left, as seen in FIG. 4, so that the angled spacing B is the same width as the horizontal spacing C. This double axis adjustment of the forming rollers is accomplished by two separate adjustments. The axial adjustment of forming roll 41 along the Y axis only is accomplished by unlocking ring 70 and turning a threaded nut 68 which is threadably joined to a movable sleeve 66. Nut 68 is restrained from any lateral movement away from roll stand 14 by a locking ring 70 and is only permitted to rotate between locking ring 70 and roll stand 14. Because of its threaded connection with sleeve 66, any rotation of nut 68 causes sleeve 66 to move along the Y axis at a rate that is controlled by the thread pitch.

The adjustment of forming roll 41 along the X axis is accomplished by rotating a sleeve 66 which includes an eccentric inside diameter which in turn supports spindle 39 through a pair of roller bearings positioned on opposite ends of sleeve 66. The eccentric nature of sleeve 66 when rotated in effect causes spindle 39 to move closer to spindle 38 along the X axis as seen in FIG. 4 thereby providing gap adjustment along the X axis. Rigidly attached to the left end of eccentric sleeve 66 is an actuating arm 72, which is also seen in FIG. 2. Arm 72 on spindle 39 is connected with spindle 38 through a tie rod 76, as seen in FIG. 2. Second actuating arm 71 is in turn connected to a connecting link 78 which connects to a bar 74. Bar 74 is in turn actuated by a hydraulic cylinder 75 or any other form of linear actuator. Actuation of the cylinder 75 thereby causes all of the eccentric sleeves in the group of roll stands 82 to move along the X and Y axis.

Again viewing FIG. 4, the gear tooth tolerance between spur gear 52 and 53 is sufficiently great to accommodate all ranges of adjustment along the X axis. In some applications, it is desirous to adjust only the lower forming roll 41 along the X axis. This is accomplished by utilizing a sleeve 66' on spindle 38 which does not have an eccentric inside diameter. The gap adjustment in the three-spindle stand 16 is accomplished only on upper spindle 42 and lower spindle 44 while middle spindle 43 does not adjust. This is accomplished by utilizing eccentric sleeve 66 on the upper and lower spindles. All of the upper and lower forming rolls 46 and 48 are connected to each other in a similar manner described in FIG. 2 through actuating arms 71, 72, tie rod 76, connecting link 78, bar 74 and linear actuator 75.

OPERATION

When it is desirous to change the roll forming Line from a Z-purlin to a C-purlin of the same dimensions, it only requires the vertical elevation of all of the three-spindle roll stands 16 to an elevated position wherein the forming rolls 47 and 48 are properly aligned in the plane of the purlin's web 86. This is accomplished at all of the progressive stations of the roll former 10, as seen in FIG. 3, by the elevation of linear actuators 24 in each group of roll stands 81, 82 and 83 to a prearranged height whereby all of the forming rolls 47 and 48 on all of the roll stands are properly aligned with forming rolls 40 and 41 on the opposing roll stands for continued operation without the need of separate alignment and adjustment of all of the various individual roll stands in the overall machine.

Although the present invention has been with respect to the specific embodiments thereof, various changes and modifications may be suggested by one skilled in the art, and it is intended that the present invention encompass such changes and modifications as follows in the scope of the appended claims.

What is claimed is:

1. A roll former line for forming different shapes comprising:

a bed;

a vertically-positioned linear bearing attached to the bed;

at least one first roll stand attached to said bed for vertical adjustable movement;

top, bottom, and middle spindles journaled to said first roll stand in vertical alignment with each other;

top, bottom, and middle forming rolls disposed on said top, bottom and middle spindles. respectively, said top and bottom forming rolls working against opposite sides of said middle forming roll, said top and middle forming rolls acting as a first alternative pair of forming rolls and said bottom and middle forming rolls acting as a second alternative pair of forming rolls;

adjustment means for moving the first roll stand vertically on the bed;

at least one second roll stand attached to said bed on an opposite side from said first roll stand;

at least two spindles mounted on said second stand in vertical alignment to each other, each spindle of said second stand supporting a forming roll wherein the adjustment means on the first roll stand can be raised or lowered so as to use alternative pairs of forming rolls on the first stand in conjunction with the forming rolls on the second roll stand to form different shapes.

2. A roll former as set forth in claim 1 including a horizontally positioned linear bearing attached to the bed supporting the second roll stand and second adjustment means for moving the second roll stand on said horizontal bearing to vary the web width of the shape being formed.

3. A roll former as set forth in claim 1 including a fine adjustment means on the second roll stand for adjusting the space between the two forming rolls of the second roll stand to accommodate the forming of different gauge material.

4. A roll former as set forth in claim 1 including a fine adjustment means on the first roll stand for adjusting the space between the top and middle forming rolls and the middle and bottom forming rolls to accommodate the forming of different gauge materials.

5. A roll former as set forth in claim 1 including a fine adjustment means on the second roll stand for adjusting the space between the forming rolls of the second roll stand along both a vertical and horizontal axis.

6. A roll former as set forth in claim 1 including a fine adjustment means on the second roll stand for adjusting the space between the forming rolls of the second roll stand along both a vertical and horizontal axis, the fine adjustment means including a rotatable sleeve mounted in the second roll stand having an eccentric inside diameter which rotatably journals one of said spindles of the second roll stand to provide an adjustment along a vertical axis and a restrained rotatable nut threaded to the outside diameter of said sleeve which provides adjustment along the horizontal axis.

7. A roll former line for forming different shapes comprising:

a bed;

at least one first roll stand attached to said bed for vertical adjustable movement;

top, bottom, and middle spindles journaled to said first roll stand in vertical alignment with each other;

top, bottom, and middle forming rolls disposed on said top, bottom and middle spindles, respectively. said top and bottom forming rolls working against opposite sides of said middle forming roll, said top and middle forming rolls acting as a first alternative pair of forming rolls and said bottom and middle forming rolls acting as a second alternative pair of forming rolls;

vertically positioned linear actuators connecting the first roll stand to the bed for moving the first roll stand vertically on the bed;

at least one second roll stand attached to said bed oppositely aligned from said first roll stand; and at least two spindles mounted on said second stand in vertical alignment to each other, each spindle of said second stand supporting a forming roll wherein the first roll stand can be raised or lowered by the linear actuators so as to use alternative pairs of forming rolls on the first stand in conjunction with the forming rolls on the second roll stand to form different shapes.

8. A roll former line for forming different shapes comprising:

a bed;

at least one first roll stand attached to said bed for vertical adjustable movement;

top, bottom, and middle spindles journaled to said first roll stand in vertical alignment with each other;

top, bottom, and middle forming rolls disposed on said top, bottom and middle spindles, respectively. said top and bottom forming rolls working against opposite sides of said middle forming roll. said top and middle forming rolls acting as a first alternative pair forming rolls and said bottom and middle forming rolls acting as a second alternative pair of forming rolls;

vertically positioned linear actuators connecting the first roll stand to the bed for moving the first roll stand vertically on the bed;

at least one second roll stand attached to said bed oppositely aligned from said first roll stand;

at least two spindles mounted on said second stand in vertical alignment to each other, each spindle of said second stand supporting a forming roll wherein the first roll stand can be raised or lowered by the linear actuators so as to use alternative pairs of forming rolls on the first stand in conjunction with the forming rolls on the second roll stand to form different shapes; and a rotatable eccentric sleeve rotatably journaling a plurality of said spindles of one of said roll stands for providing an adjustment between a plurality of the forming rolls of said one roll stand along a vertical axis.

9. A roll former line as set forth in claim 8 including an actuating arm attached to each of said eccentric sleeves for rotating said sleeves and tie rod means for connecting said actuating arms together for uniform movement of said sleeves.

10. A roll former line for forming different shapes comprising:

at least one first roll stand;

top, bottom, and middle spindles journaled to said first roll stand in linear alignment with each other;

top, bottom, and middle forming rolls disposed on said top, bottom and middle spindles, respectively, said top and bottom forming rolls working against opposite sides of said middle forming roll, said top and middle forming rolls acting as a first alternative pair of forming rolls and said bottom and middle forming rolls acting as a second alternative pair of forming rolls;

at least one second roll stand being oppositely disposed from said first roll stand;

an actuator for changing the elevation of said first roll stand relative to the elevation of said second roll stand; and at least two spindles mounted on said second roll stand in linear alignment to each other, each of said spindles of said second roll stand supporting a forming roll, wherein said first roll stand can be raised or lowered relative to said second roll stand by said actuator so as to use alternative pairs of forming rolls of said first stand in conjunction with said forming rolls of said second roll stand to form different shapes.

11. A roll former apparatus, comprising:

a first roll stand;

top, bottom, and middle spindles journaled in said first roll stand;

top, bottom, and middle forming rolls disposed on said top, bottom, and middle spindles, respectively, said top and bottom forming rolls working against opposite sides of said middle forming roll;

a second roll stand disposed oppositely from said first roll stand;

first and second spindles journaled in said second roll stand;

first and second forming rolls disposed on said first and second spindles, respectively; and an actuator for changing the elevation of said top, bottom and middle forming rolls of said first roll stand relative to the elevation of said first and second forming rolls of said second roll stand so that components having different shapes can be formed.

12. An apparatus as defined in claim 11 wherein said actuator comprises actuating means for disposing said forming rolls of said first roll stand at a first elevation relative to said forming rolls of said second roll stand so that a component having a C-shaped cross section is formed between a first two of said forming rolls of said first roll stand and said first and second forming rolls of said second roll stand and for disposing said forming rolls of said first roll stand at a second elevation relative to said forming rolls of said second roll stand so that a component having a Z-shaped cross section is formed between a second two of said forming rolls of said first roll stand and said first and second forming rolls of said second roll stand.

13. An apparatus as defined in claim 12 wherein said first two forming rolls are said top and middle forming rolls and wherein said second two forming rolls are said bottom and middle forming rolls.

14. An apparatus as defined in claim 11 wherein said first roll stand comprises a plate, wherein said top, bottom and middle spindles are journaled in said plate, and wherein said actuator acts to change the elevation of said plate.

15. An apparatus as defined in claim 14 wherein said actuator comprises a vertically disposed screw actuator.

16. A roll former apparatus, comprising:

a first roll stand comprising a plate;

top, bottom, and middle spindles journaled in said plate in a linear relationship with each other;

top, bottom, and middle forming rolls disposed on said top, bottom, and middle spindles, respectively, said top and bottom forming rolls working against opposite sides of said middle forming roll;

a second roll stand disposed oppositely from said first roll stand;

first and second spindles journaled in said second roll stand in a linear relationship with each other;

first and second forming rolls disposed on said first and second spindles, respectively; and an actuator for changing the elevation of said plate in which said top, bottom and middle forming rolls of said first roll stand are journaled relative to the elevation of said first and second forming rolls of said second roll stand so that components having different shapes can be formed, said actuator comprising actuating means in the form of a vertically disposed screw actuator for disposing said forming rolls of said first roll stand at a first elevation relative to said forming rolls of said second roll stand so that a component having a C-shaped cross section is formed between a first two of said forming rolls of said first roll stand and said first and second forming rolls of said second roll stand and for disposing said forming rolls of said first roll stand at a second elevation relative to said forming rolls of said second roll stand so that a component having a Z-shaped cross section is formed between a second two of said forming rolls of said first roll stand and said first and second forming rolls of said second roll stand.

* * * * *